US005962175A

United States Patent [19]

Tanaka et al.

[11] Patent Number: 5,962,175

[45] Date of Patent: Oct. 5, 1999

[54] BINDER-TYPE CARRIER AND METHOD OF MANUFACTURING SAME

[75] Inventors: Yoshiaki Tanaka, Amagasaki; Hideaki Yasunaga, Sakai; Tomoharu Nishikawa, Hirakata, all of Japan

[73] Assignee: Minolta Co., Ltd., Osaka, Japan

[21] Appl. No.: 09/027,620

[22] Filed: Feb. 23, 1998

[30] Foreign Application Priority Data

Feb. 21, 1997 [JP] Japan ..... 9-037512

[51] Int. Cl.[6] ..... G03G 9/107

[52] U.S. Cl. ..... 430/106.6; 430/108; 430/137

[58] Field of Search ..... 430/106.6, 108, 430/137

[56] References Cited

U.S. PATENT DOCUMENTS 4,600,675 7/1986 Iwasa et al. ..... 430/106.6
4,847,176 7/1989 Sano et al. ..... 430/106.6
4,885,222 12/1989 Kaneko et al. ..... 430/102
5,190,842 3/1993 Saha et al. ..... 430/108
5,565,291 10/1996 Mayama et al. ..... 430/106.6
5,686,219 11/1997 Higuchi ..... 430/137
5,834,152 11/1998 Yasunaga et al. ..... 430/108

*Primary Examiner*—John Goodrow
*Attorney, Agent, or Firm*—Burns, Doane, Swecker & Mathis, LLP

[57] ABSTRACT

A binder-type carrier which does not cause image defects or uneven density and has excellent production characteristics, and a binder-type carrier manufactured by said method. The binder-type carrier has a magnetic powder content of 75–90 wt % and is produced by pulverizing via a mechanical pulverizer a material which has been kneaded within a predetermined temperature range using an extrusion kneader provided with two or more kneading units.

20 Claims, 6 Drawing Sheets

BINDER-TYPE CARRIER AND METHOD OF MANUFACTURING SAME

Applicants claim priority of Japanese Patent Application 09-037512, filed Feb. 21, 1997, the entire contents of which are hereby incorporated by reference.

BACKGROUND OF THE INVENTION

1. Field of the Invention

The present invention relates to a carrier for use in two-component developers comprising a toner and a carrier, and more specifically relates to a binder-type carrier comprising magnetic powder dispersed in a binder resin and method of manufacturing the carrier.

2. Description of the Related Art

Image forming apparatuses, such as copiers and printers of the electrophotographic-type, which use a two-component developer including a toner and a carrier to develop an electrostatic latent image formed on an image-carrying member such as a photosensitive member or the like are known.

In recent years, however, organic photosensitive members provided with an organic photosensitive layer superimposed on sequential laminations of a charge-generating layer and a charge-transporting layer on an electrically conductive substrate have been proposed. These photosensitive members are said to have excellent photosensitivity, excellent stability and low manufacturing cost.

Such organic photosensitive members include a negative charging photosensitive member and a highly efficient normal hole transporting material as a charge-transporting material. Developing must be accomplished by a reverse developing method using a developer with a negatively chargeable toner in order to use the organic photosensitive member in a digital-type image forming apparatus. Therefore, a negatively chargeable two-component developer having excellent characteristics is required.

There are various known carriers including magnetic carriers, iron powder carrier, ferrite carrier, carriers covered by a resin containing magnetic powder or iron or ferrite, binder-type carriers comprising a magnetic powder dispersed in a binder resin and the like. Among these carriers, the binder-type carriers have gained attention as carriers which can be readily produced in small particle size, have a high volume specific resistivity, and resist charge injection from the developer-carrying member.

A carrier having a suitable chargeability relative to a negatively chargeable toner must have an amount of magnetic powder on the carrier surface within a suitable range to act as charging points for the negatively chargeable toner. The amount of magnetic powder on the carrier surface can be measured by dissociating the magnetic powder present on the carrier surface. This dissociation may be accomplished by introducing the carrier into a solvent, such as an acid or the like, capable of dissolving the magnetic powder.

However, adequate chargeability relative to negatively chargeable toner may not be obtained even if a suitable amount of surface magnetic powder is confirmed using this measurement method. The causes of this inadequate chargeability is thought to be due to uneven dispersion of the magnetic powder in the binder resin, wherein free magnetic powder is mixed in during the manufacturing process so as to produce flocculation of magnetic powder contained in the carrier. This disadvantage becomes more pronounced when the magnetic powder content is increased to improve the chargeability of the carrier relative to the negatively chargeable toner.

It is difficult to simply eliminate free magnetic powder by classification since, due to the large particle size difference of the carrier particles, it readily adheres to the carrier particles. Nonetheless, the disadvantage caused by this fine powder content can be eliminated by removing the free magnetic powder. The free magnetic powder can be eliminated by improving the precision of the classification process or increasing the number of classifications. In this case, however, the classification process becomes quite complex and reduces manufacturing efficiency.

Moreover, a further disadvantage of uneven image density occurs when this type carrier is used for image formation under conditions of high temperature and high humidity (H/H).

SUMMARY OF THE DISCLOSURE

An object of the present invention is to provide a method of manufacturing a binder-type carrier which does not suffer from the disadvantages of image defects and uneven density, and which has excellent manufacturing characteristics.

A further object of the present invention is to provide a suitable method of manufacturing a binder-type carrier containing a high amount of magnetic powder such as ferrite, magnetite, iron powder, hematite or the like, preferably in a range of about 75 to about 90 percent-by-weight based upon the total weight of the carrier.

An even further object of the method of the present invention is to provide a binder-type carrier with improved uniform dispersibility of a magnetic powder in a binder resin.

These objects are desirably attained by providing a binder-type carrier, wherein the carrier magnetic powder content a1 and the carrier surface magnetic powder exposure amount b satisfy the relation described in Equation (I) below $$b=0.4(a\mathbf{1}-80)+k\mathbf{1} \quad \text{(I)}$$

wherein a1 is about 75 to about 90 percent-by-weight and k1 is about 4 to about 13 percent-by-weight, the carrier shape coefficient is about 0.8 to about 0.95, and the ratio of the carrier volume-average particle size Dv and the number-average particle size Dp (i.e., Dv/Dp) is less than about 1.3.

The objects of the present invention are further attained by providing a developing method to develop an electrostatic latent image formed on the surface of a negatively chargeable organic photosensitive member. The developing method is achieved by reverse developing using a two-component developer including the carrier of the present invention and a negatively chargeable toner.

The objects of the present invention are further attained by providing a method of manufacturing a binder-type carrier having a magnetic powder content of about 75 to about 90 percent-by-weight produced by (1) fusion kneading a mixture of at least a binder resin and a magnetic powder using an extrusion kneader having a cylinder provided with a transport unit in an axial direction and two or more kneading units, wherein the total transport unit length is designated L, the total kneading unit length is designated Ln, the screw diameter is designated D, the transport unit length from a first kneading unit is designated L1, the transport unit length from a final kneading unit is designated Lx, and the spacing between kneading units is designated Ln', such that L/D is 23 or greater, Ln/D is less than 6, L1/L is 0.05 or greater, Lx/L is less than 0.87, and Ln'/L is less than 0.05, said fusion kneading being accomplished under conditions which satisfy Equation (II) below $$c=7.2(a1-75)+k2 \quad \text{(II)}$$

wherein C is the cylinder temperature (°C.), a1 is the amount of magnetic powder which ranges from about 75 to about 90 percent-by-weight, and k2 is a temperature within a range from the binder resin softening point to the softening point +48° C.; and (2) pulverizing the obtained fusion-kneaded material using a mechanical pulverizing device.

The other objects, advantages, and features of the invention will become apparent to those skilled in the art from the following description of preferred embodiments of the invention, as illustrated in the accompanying drawings.

BRIEF DESCRIPTION OF THE DRAWINGS

In the following description, like parts are designated by like reference numbers throughout the several drawings.

DETAILED DESCRIPTION OF THE PREFERRED EMBODIMENTS

An extrusion kneading device used in the carrier manufacturing method of the present invention is provided with a cylinder having a transport unit in the axial direction with two or more kneading units. The total transport unit length is designated L, the total kneading unit length is designated Ln, the screw diameter is designated D, the transport unit length from a first kneading unit is designated L1, the transport unit length from a final kneading unit is designated Lx, and the spacing between kneading units is designated Ln', L/D is preferably about 23 or greater, and more preferably about 23 to about 50; Ln/D is preferably less than about 6, and more preferably about 2 to about 6; L1/L is preferably about 0.05 or greater, and more preferably about 0.05 to about 0.25; Lx/L is preferably less than about 0.87, and more preferably about 0.5 to about 0.87; and Ln'/L is preferably less than about 0.05, and more preferably about 0.05 to about 0.3.

Figure 1:
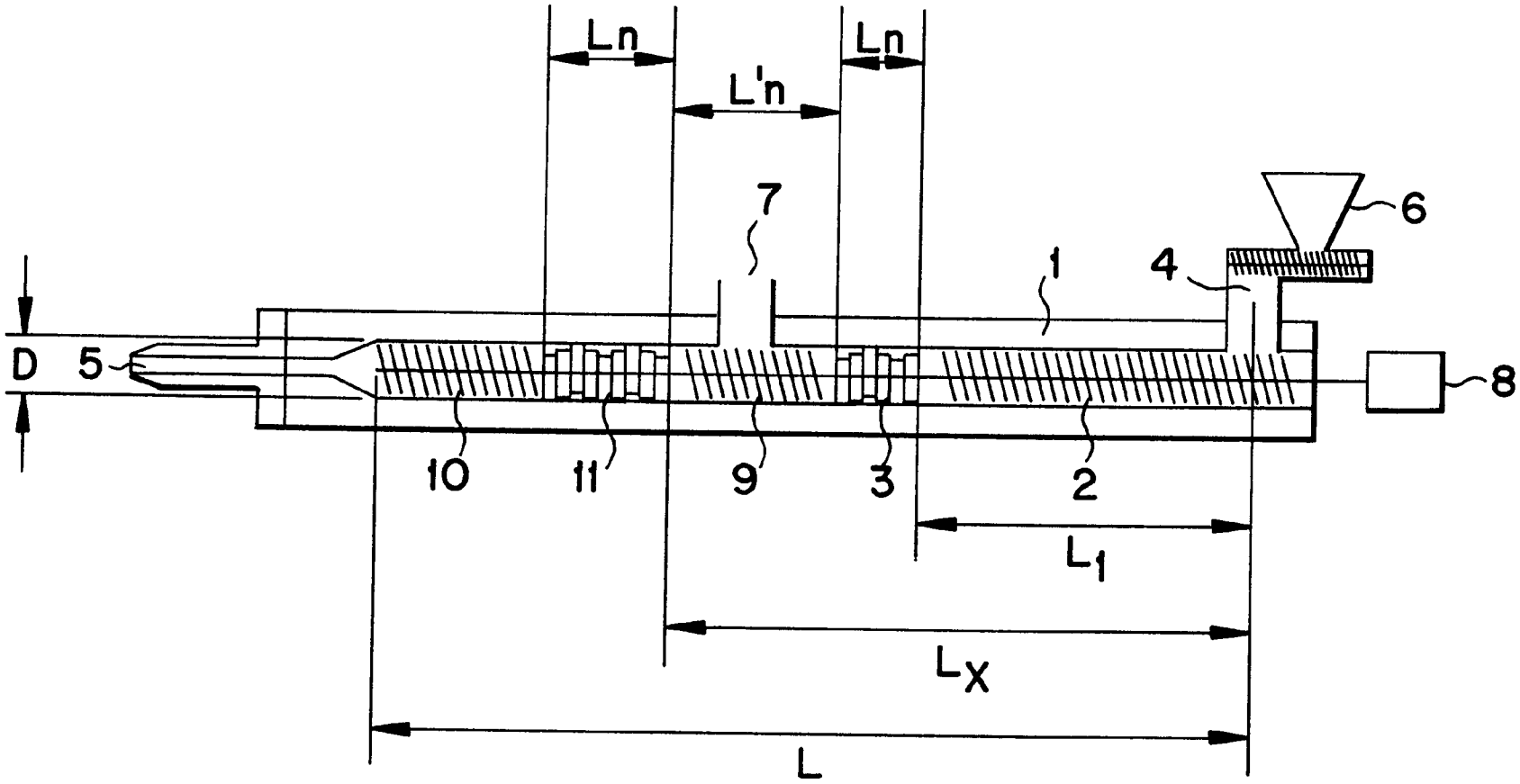
FIG. 1 illustrates the construction of an embodiment of the present invention in the mode of an extrusion kneader provided with two kneading units.

The aforesaid construction is described hereinafter with reference to FIG. 1. FIG. 1 briefly shows the construction of an extrusion kneader provided with a cylinder having a transport unit in an axial direction and two kneading units.

Reference number 1 refers to a cylinder provided with a heating means. Reference number 6 refers to a material supply means disposed at one end of the cylinder, and reference number 5 refers to a discharge aperture provided at the other end of the cylinder. Within the cylinder between material supply means 6 and discharge aperture 5 are provided sequential from the material supply means side a first transport unit 2, a first kneading unit 3, a second transport unit 9, a second kneading unit 11, and a third transport unit 10. A vent hole 7 is provided between the material supply intake and discharge to allow air to escape.

During the manufacture of the carrier, material is supplied from the material supply means 6 to the transport unit 2, and is gradually heated to a molten state in the first transport unit 2 by the cylinder driven by a motor 8, and is fusion kneaded in the first kneading unit 3. The transport units are a paddle construction using two and three screws as paddles. The kneading material is retained and fills the kneading unit without any transport effect. The material is kneaded by compression and stretching via the rotation of the paddles to vary the volume. Kneading is further accomplished by the shearing action produced between the paddles and between the paddle and the heated cylinder wall. The kneaded material in the first kneading unit 3 is then pushed to the second kneading unit on the discharge aperture side of the cylinder via the kneading material moving from behind through the first transport unit 2, such that the kneaded material moves through the second transport unit 9 to the second kneading unit 11, and from the second kneading unit 11 to the third transport unit 10 so as to be discharged from the discharge aperture 5.

The kneading device used in the present invention is constructed such that when the total transport unit length is designated L, the total kneading unit length is designated Ln, the screw diameter is designated D, the transport unit length from a first kneading unit is designated L1, the transport unit length from a final kneading unit is designated Lx, and the spacing between kneading units is designated Ln', the value L/D is desirably about 23 or greater, Ln/D is desirably less than about 6, L1/L is desirably about 0.05 or greater, Lx/L is desirably less than about 0.87, and Ln'/L is desirably less than about 0.05.

The total length L of the transport units is the length from the center of the supply aperture 4 to a position nearest the discharge aperture of the final transport unit, as shown in FIG. 1. This length is in the axial direction, i.e., the direction of the material moving toward the discharge aperture. In the present description of the invention, length refers to the length in the direction of the discharge aperture at all times.

The total kneading unit length Ln is the total length of both the kneading units. If three kneading units are used this length would refer to the total length of all three kneading units.

Screw diameter D is the diameter of the cross section of perpendicular to the cylindrical axis of the empty cylinder of the transport unit and the kneading unit. A diameter D of 10 mm or greater is most desirable; although the upper limit of diameter value is not particularly restricted, a kneading device having a diameter of less than 100 mm is desirable from the perspective of the size of the device. A desirable kneading device typically will have a screw diameter D of about 30 to about 65 mm.

The transport length L1 from the first kneading unit is the length from the center of the supply aperture 4 to the end of the first kneading unit on the side of supply aperture 4.

The transport length L2 to the second kneading unit is the length from the center of the supply aperture 4 to the end of the second kneading unit on the side of supply aperture 4.

When three or more kneading units are used, the transport length Lx is used to the final kneading unit nearest the discharge aperture side, and this length Lx is the length from the center of the supply aperture 4 to the end of the final kneading unit on the supply aperture 4 side. In this case, the setting of the kneading device will satisfy a value of L/D of about 23 or greater, Ln/D is less than about 6, L1/K is about 0.05 or greater, Lx/L is less than about 0.87, and Ln'/L is about 0.05 or greater. The desirable range is the same as stated above.

The cylinder temperature c (°C.) is set so as to satisfy Equation (II).

$$c=7.2(a1-75)+k2 \quad \text{(II)}$$

wherein a1 is about 75 to about 90 percent-by-weight (hereinafter referred to as "wt %") and k2 is a temperature in a range from the softening point of the binder resin to the softening point +48° C., and preferably in a range from the softening point +12° C. to the softening point temperature +36° C.

Binder resins normally used in the manufacture of a binder-type carrier are polyester, polystyrene, styrene-acrylic, phenol, polyethylene, epoxy, and urethane which have softening temperatures Tm in the range of about 110 to about 150° C., and may be used as a binder resin in the present invention.

Figure 2:
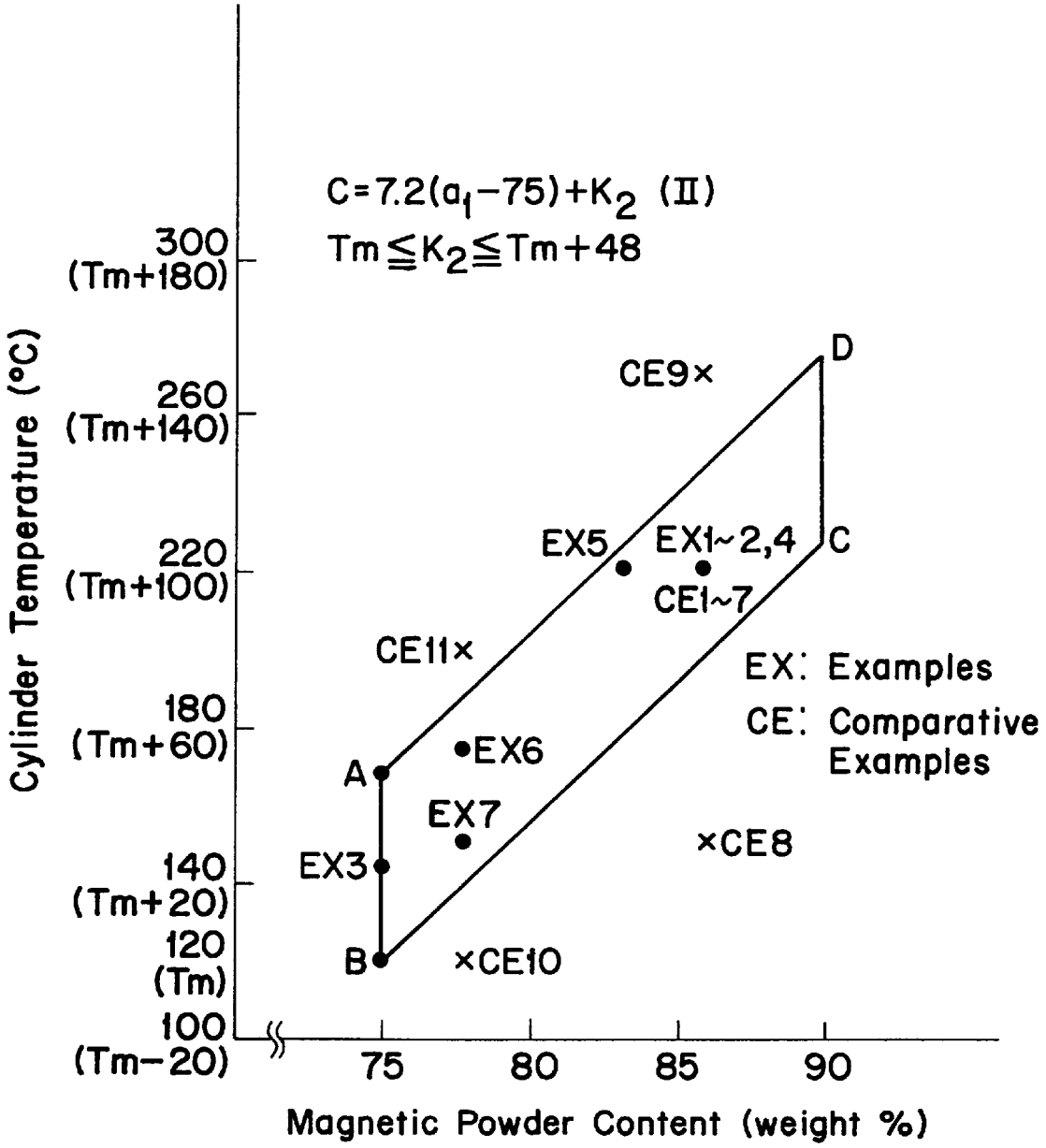
FIG. 2 is a graph illustrating the relationship between the cylinder temperature and the magnetic powder content in the present invention.

Equation (II) expresses the relationship between the optimum cylinder temperature for a desired magnetic powder content; this relationship is shown in FIG. 2. FIG. 2 shows the magnetic powder content a1 (wt %) on the horizontal axis, and the cylinder temperature on the vertical axis. In FIG. 2, the binder resin softening point Tm (°C.) is shown at an example of 120° C. The area within the parallelogram ABCD is the range wherein the relationship between magnetic powder content and cylinder temperature of the present invention is satisfied.

When, for example, a carrier having a magnetic powder content of 75 wt % is desired, the cylinder temperature is set between about 120° C. (Tm) to about 168° C. (Tm+48° C.), and preferably in a range of about 132 to about 156° C. When a carrier having a magnetic powder content of 80 wt % is desired, the cylinder temperature is set at about 156 to about 204° C., and preferably about 168 to about 192° C.

The above example used a softening point Tm of 120° C. When the binder resin softening point is 140° C., the position of point B representing a softening point Tm of 120° C. on the vertical axis in FIG. 2 is moved to 140° C., so as to read the cylinder temperature that must be set to obtain a desired magnetic powder content for a binder resins with a softening point of 140° C.

When manufacturing a high density binder-type carrier as described above, the cylinder temperature changes depending on the magnetic powder content and the resin softening point Tm, such that an optimum resin viscosity can be set at a desired magnetic powder content. This avoids over melting which causes a reduction in viscosity, and avoids blocking of the kneaded material in the transport units within the cylinder.

When the value L/D is less than 23, or when a single kneading unit is used, however, there is inadequate retention of the fusion kneaded material of raw material, which leads to inadequate dispersion of the magnetic powder in the binder resin, and results in non-printing white spots in images formed using a carrier manufactured by the kneading device. The upper limit of the value L/D is desirably 50 from the perspective of improving production yield by having the dispersibility improvement in the saturation range.

When the value Ln/D is greater than 6, there is minimal effectiveness in transporting the kneaded material in the direction of the discharge aperture, such that kneaded material retained in the transport unit loses its viscosity and effectively blocks the transport unit. The lower limit of the value Ln/D is desirably 2 from the perspective of improved dispersibility.

When the value L1/L expressing the position of the first kneading unit is less than 0.05, there is a deterioration of the supply characteristics of material supplied from the material supply aperture 4 to the first transport unit, i.e., the intake of material to the first transport unit is reduced such that material from the supply aperture becomes blocked near the inlet to the first transport unit, thereby causing a "bridge." The upper limit of the value L1/L is desirably about 0.25 to avoid reducing manufacturing qualities when the distance is too long.

When the value Lx/L expressing the position of the final kneading unit is greater than 0.87, screw transport characteristics are reduced near the discharge aperture. The lower limit of this value is desirably 0.5 from the perspective of improving manufacturing characteristics by increasing the length of the transport path to the discharge aperture.

When the value Ln'/L expressing the spacing between kneading units is less than 0.05, the kneaded material attains a low viscosity which reduced dispersibility. The upper limit of this value is desirably 0.3 from the perspective reducing manufacturing characteristics if the spacing is too large.

The kneaded material obtained by the previously described method has improved dispersibility of magnetic powder in binder resin, and produces very little free magnetic powder even in subsequent pulverization processing. This reduces the amount of fine powder removed by fine powder classification and improves yield. When this kneaded material is pulverized using a jet pulverizer, however, uneven image density results under conditions of high temperature and high humidity even though the carrier using this kneaded material has excellent magnetic powder dispersibility.

Therefore, the kneaded material which has been kneaded by the previously described extrusion kneader is pulverized by a mechanical pulverizer. Specifically, the cooled kneaded material is coarsely pulverized. Thereafter, using a mechanical pulverizer, these coarsely pulverized particles are fed into a pulverization area between the wall surface of the pulverizer and a rotor arranged with a slight spacing relative to the wall. Therein, these coarsely pulverized particles are further pulverized via impact with the rotor and the interior wall so as to shave off the surface irregularities of the particles and render them spherical.

The rotor is formed so as to have a plurality of channels in the axial direction on the exterior surface relative to the interior wall, and a plurality of pins are arranged on the exterior top surface of the disk so as to confront the interior wall surface and form an area of concavoconvexities confronting the interior wall surface of the pulverizer. The coarsely pulverized particles repeatedly impact the concavoconvexities of the exterior surface of the rotor as well as the interior wall surface of the pulverizer in the pulverization region. The large size particles are pulverized, and the surface of the pulverized particles are polished so as to be rendered spherical. The spherical particles are discharged with air.

When a coarse pulverizer is combined with the mechanical pulverizer, the coarsely pulverized particles may be repeatedly supplied to the pulverization region until they are smaller than a predetermined size. Only particles smaller than a predetermined size are discharged as finished particles. This type of closed circuit pulverization can improve the sphericalization of the particles. Examples of suitable mechanical pulverizers include the Inomizer (Hosokawa Micron), and ACM pulverizer (Hosokawa Micron).

In the case of a mechanical pulverizer which is not combined with a coarse pulverizer, a separate coarse classifying device is used to again supply coarse particles to a mechanical pulverizer. Particles smaller than a predetermined size are the finished particles. An example of such a mechanical pulverizer is the Kuriptron (Kawasaki Heavy Industries).

The effectiveness of the present invention is achieved by a mechanical pulverizer to pulverize the particles and render the surface of the pulverized particles spherical. On the other hand, the effect of the present invention cannot be obtained using a jet-type pulverizer wherein particles impinge an impact plate. An example of a jet-type pulverizer is the model IDS (Nippon Pneumatic).

The pulverized particles may be subjected to fine classification as necessary. Carrier particles are desirably adjusted to a volume-average particle size of about 20 to about 80 $\mu$m.

Binder-type carrier produced by the method described above desirably has a shape coefficient of about 0.8 to about 0.95, the ratio of the carrier volume-average particle size Dv and the number-average particle size Dp (i.e., Dv/Dp) is less than 1.30, and the magnetic powder content in the binder resin is about 75 to about 90 wt %, that is, the magnetic powder content and the amount b of magnetic powder exposed on the particle surface satisfy Equation (I).

$$b=0.4(a1-80)+k1 \quad \text{(I)}$$

wherein a1 is about 75 to about 90 wt %, and k1 is about 4 to about 13 wt %.

Since the kneaded material produced by the method improves dispersibility of the magnetic powder in the binder resin, there is minimal free magnetic powder produced during the pulverization process. Further, yield reduction by classification is also minimal even when the ratio Dv/Dp of the carrier is adjusted to less than 1.30. Moreover, excellent charging characteristics are obtained relative to negatively chargeable toner by controlling the relationship of the amount of magnetic powder exposed on the carrier surface relative to the magnetic powder content of the carrier within the scope of Eq. (I) to minimize the generation of free magnetic powder. In addition, the problem of uneven image density can be eliminated under conditions of high temperature and high humidity by desirably controlling the shape coefficient of the carrier within a range from about 0.8 to about 0.95 via the sphericalization aspect of the pulverization process.

The shape coefficient in the present invention expresses a value calculated using a carrier projection image via the equation below using an image analysis device (model LA-525, PIAS, Ltd.).

$$\text{Shape coefficient}=(\text{surface area})\times(\text{circumferential length})$$

Where (surface area) represents the projected surface area of a projection image of carrier particles, and (circumferential length) represents the length of the circumference of the projection image of the carrier particles. Carrier particles having a shape coefficient near 1 are near spherical.

When the shape coefficient is less than 0.8, flow characteristics worsen, and image density irregularities result under conditions of high temperature and high humidity (H/H). When the shape coefficient exceeds 0.95, charging characteristics become unstable as the toner component readily adheres to the carrier during printing (i.e., spent carrier). A shape coefficient in a range of about 0.82 to about 0.92 is more desirable.

Since the spherical coefficient is not a value which changes depending on the type of measuring device used or the company of manufacture, the shape coefficient in the present invention is not a value which must be measured using the previously mentioned measuring device.

The volume-average particle size Dv and the number-average particle size Dp are values measured using a Coulter Multisizer II (Coulter, Inc.). When the distribution Dv/Dp is greater than about 1.30, there is an increase in the percentage of fine powder mixed in the carrier, which causes fog in produced images and multiplicity of printed points due to carrier adhesion. The lower limit of this value is desirably 1.05 from the perspective of production yield. A desirable range of the ratio Dv/Dp is about 1.07 to about 1.28.

The amount of magnetic powder exposed on the surface of the carrier particles was measured by the method described below. The magnetic powder used in the carrier was dissolved in dilute hydrochloric acid, and the spectral transmittance was measured using a spectrophotometer, and a calibration curve was determined from the magnetic powder content in the solution at 50% transmittance at wavelength $\lambda 50$. Samples of the carrier and dilute hydrochloric acid were batched, mixed in a glass bottle for 30 min, and the magnetic powder on the surface of the carrier was eluted. The eluting solution was filtered and the spectral transmittance of the filtrate was measured using a spectrophotometer to determine the wavelength of 50% transmittance. Then the magnetic powder content in the filtrate was determined from the calibration curve. The calculated value was expressed as a percentage relative to the weight of the sample carrier and was designated the amount of magnetic powder exposed on the surface of the carrier particles.

Figure 3:
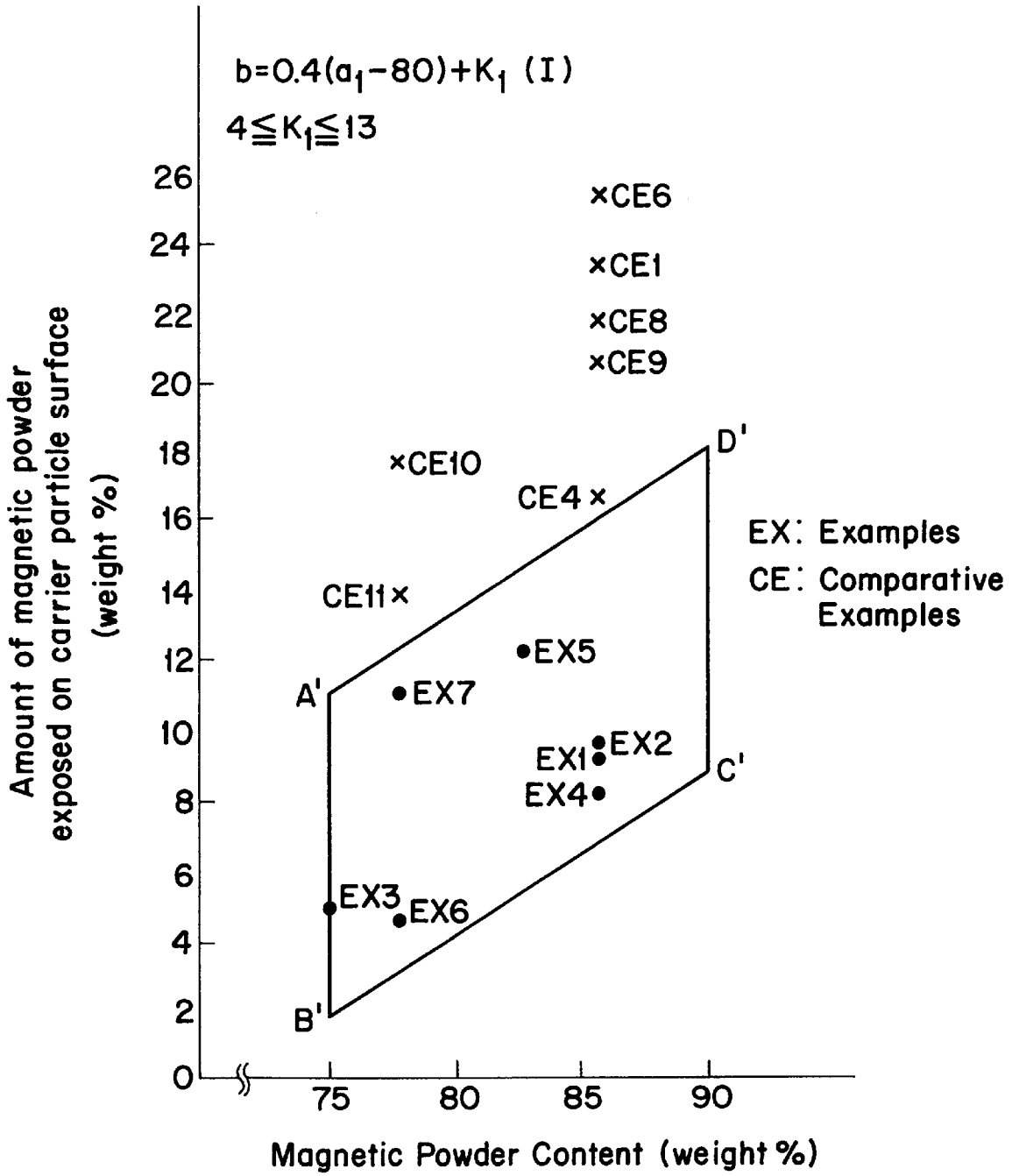
FIG. 3 is a graph illustrating the relationship between the amount of magnetic powder exposed on the carrier surface and the magnetic powder content in the present invention.

Equation (I) expresses the range of a constant amount magnetic powder in a binder-type carrier exposed on the surface of the carrier particles. The range is shown in FIG. 3. FIG. 3 shows the magnetic powder content (percent-by-weight) on the horizontal axis, and the amount b of magnetic powder exposed on the carrier particle surface (percent-by-weight). The area within the parallelogram A'B'C'D' is the range wherein the aforesaid relationship between magnetic powder content and amount of exposed magnetic powder in the present invention is satisfied.

When, for example, a carrier having a magnetic powder content of 75 wt % is desired, the obtained carrier will have an amount of exposed magnetic powder of about 2 to about 11 wt %; when a carrier having a magnetic powder content of 80 wt % is desired, the obtained carrier will have an amount of exposed magnetic powder of about 4 to about 13 wt %.

When the amount of exposed magnetic powder is excessive, bias leaks occur which cause image defects during printing and uneven density under conditions of high temperature and high humidity (H/H).

From the above description it can be understood that the binder-type carrier of the present invention is a carrier having about 75 to about 90 wt % magnetic powder dispersed in a binder resin, the carrier magnetic powder content a1 (wt %) and the amount b of exposed magnetic powder (wt %) satisfies Eq. (I) below $$b=0.4(a1-80)+k1 \quad \text{(I)}$$

wherein a1 is about 75 to about 90 (wt %), and k1 is about 4 to about 13 (wt %), and preferably about 6 to about 9 (wt %), the carrier shape coefficient is about 0.8 to about 0.95, and the ratio of the volume-average particle size Dv and the number-average particle size Dp (i.e., Dv/Dp) is less than about 1.30.

Now, the preferred embodiments of aspects of the present invention will be described more specifically with reference to examples. Unless otherwise stated, the examples are merely illustrative and should not be considered a limitation of the present invention.

EXAMPLES 1 AND 2 AND COMPARATIVE EXAMPLES 1–7

The resins, magnetic powders, carbon black, and silica product names and manufacturers, physical properties, and parts used to manufacture the carrier of the examples below are shown in Table 1.

TABLE 1

| Material | Parts | Name | Mfr. | Properties |
|---|---|---|---|---|
| Resin | 100 | Tafton | Kao | 120° C. |
| Magnetic powder | 650 | MFP-2 | TDK | 6.8 $m^2$ |
| Carbon black | 2 | Ketchen Black | Lion Oils | |
| Silica | 1.5 | #200 | Japan Aero-Sil | 205 $m^2/g$ |

In Table 1, Tafton is a polyester resin having a softening point of 120° C. The magnetic powder is ferrite.

The materials shown in Table 1 were mixed and kneaded, and the kneaded material was coarsely pulverized, then finely pulverized and classified, and subjected to heat processing to produce the carriers of Examples 1, 2 and comparative Examples 1–7.

The mixing process at this time was accomplished using a Henschel mixer (Mitsui-Meke Co. Ltd.) mixing for 2 min at 4,000 rpm. Kneading was accomplished using a twin-shaft extrusion kneader (Ikegai Tekko; screw diameter D: 30 mm), with a material supply rate of 6 kg/hr, 230 rpm, and a cylinder temperature of 220° C.

Figure 4:
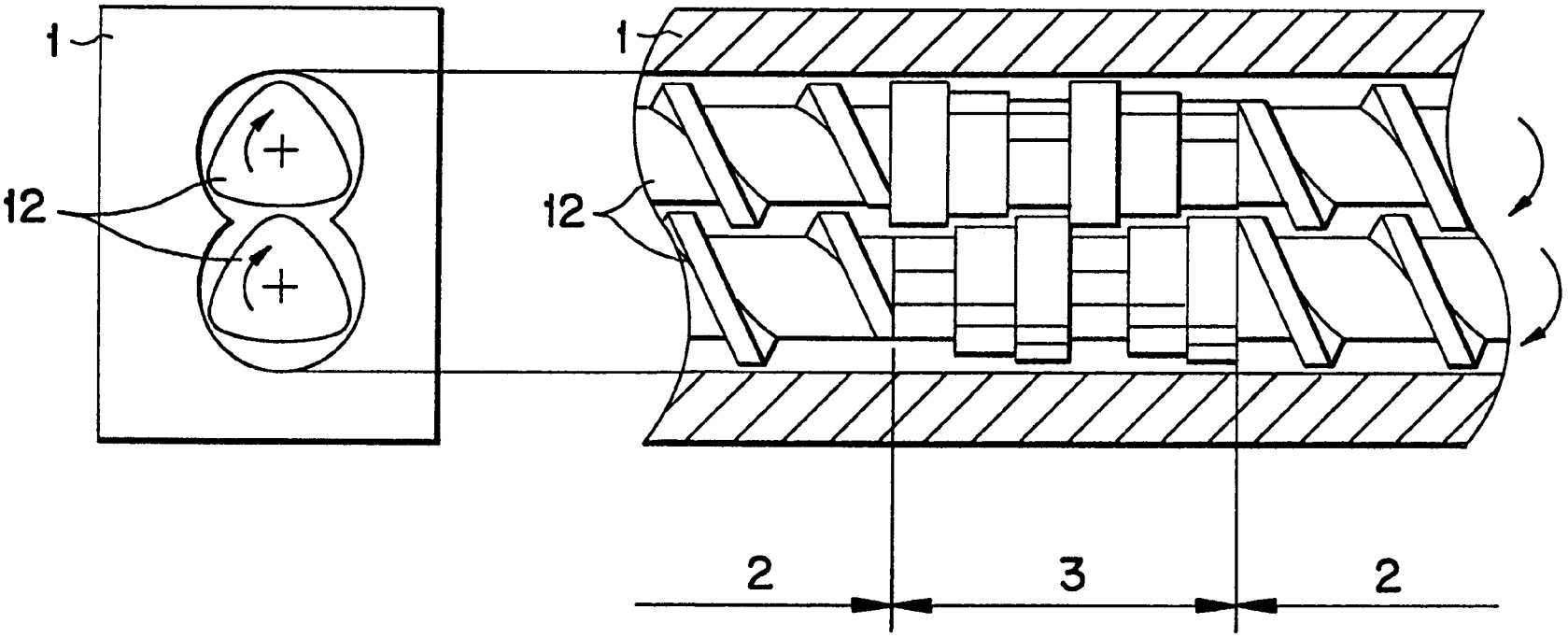
FIG. 4 illustrates the construction of the transport unit and the kneading unit of an extrusion kneader of an embodiment of the present invention.

FIG. 4 briefly shows the construction of the transport unit and the kneading unit used in the present examples. The paddles used were provided with three screws and formed a triangular cross section as shown at the left edge of FIG. 4. Two paddles of the transport unit 2 were screw types rotating in the same direction, such that two screw threads invariably made contact at a point due to the right angle section of the engaging parts, and a line connecting the contact points forms a screw thread contour from one screw base to another.

The kneading unit 3 comprises a kneading disk combining a disk to increase the kneading action. This disk has the same right angle cross section and shape shown in FIG. 4, such that a segment incorporating a plurality of such disks is installed midway in the paddle. Since the disk phase changes slightly, material is subjected to a strong shearing action between the cylinder wall and between the mutual disk surfaces so as to be vigorously kneaded.

Other conditions of these examples include, in equation (II), a magnetic powder content of 85.7 wt % (600/700×100), and a cylinder temperature set about 100° C. higher than the resin Tafton softening point (120° C.). Pulverization was accomplished using a ACM pulverizer (Hosokawa Micron) or an IDS jet pulverizer (Nippon Pneumatic). In both cases, a coarse pulverizer was used under closed circuit conditions.

TABLE 2

| | L/D | No. of kneadings | Ln/D | 1st Knead unit position $L_1/L$ | Final knead unit position $L_x/L$ | Knead unit spacing Ln'/L | Cylinder Temp. C (° C.) | Kneader |
|---|---|---|---|---|---|---|---|---|
| Ex. 1 | 32 | 2 | 1.85 | 0.2 | 0.65 | 0.41 | 220 | ACM |
| Ex. 2 | 28 | 2 | 3.07 | 0.15 | 0.75 | 0.56 | 220 | ACM |
| CE. 1 | 20 | 2 | 4.31 | 0.1 | 0.65 | 0.43 | 220 | IDS |
| CE. 2 | 30 | 2 | 8.0 | 0.14 | 0.65 | 0.41 | 220 | — |
| CE. 3 | 30 | 3 | 5.54 | 0.04 | 0.53 | 0.15 | 220 | — |
| CE. 4 | 30 | 1 | 4.31 | 0.22 | — | — | 220 | IDS |
| CE. 5 | 30 | 2 | 4.31 | 0.22 | 0.92 | 0.64 | 220 | — |
| CE. 6 | 30 | 2 | 4.31 | 0.1 | 0.18 | 0.02 | 220 | IDS |
| CE. 7 | 24 | 3 | 4.92 | 0.1 | 0.55 | 0.15 | 220 | IDS |

The obtained carrier had a volume-average particle size of 55 μm. Table 3 shows the properties of the obtained carrier, e.g., amount of exposed magnetic powder on carrier surface, ratio Dv/Dp of volume-average particle size Dv and number-average particle size Dp, dynamic current value (CDC), and apparent density (AD). The carriers obtained in examples 1 and 2 and comparative examples 1–7 had less than 2% of particles with a particle size of 32 μm or less.

TABLE 3

| | Magnetic powder content (wt %) ($a_1$ | Amount of exposed powder (wt %) (b) | Shape coefficient | Dv/Dp | CDC (nA) |
|---|---|---|---|---|---|
| Ex. 1 | 85.7 | 9.0 | 0.82 | 1.28 | 93 |
| Ex. 2 | 85.7 | 9.2 | 0.91 | 1.18 | 120 |
| CE. 1 | 85.7 | 23.1 | 0.58 | 1.44 | 250 |
| CE. 4 | 85.7 | 16.7 | 0.69 | 1.38 | 312 |
| CE. 6 | 85.7 | 25.0 | 0.51 | 1.57 | 411 |
| CE. 7 | 85.7 | 8.8 | 0.55 | 1.50 | 72 |

The amount of exposed magnetic powder, shape coefficient, and Dv/Dp ratio are values measured by the previously described methods.

The measurement of the dynamic current value (CDC) was accomplished as follows. A sample of 5 g of carrier weighed using a precision balance scale, was uniformly spread on the entire surface of a conductive sleeve having a built in magnetic roller with a magnetic flux density of 1000 Gauss. The spacing between the conductive sleeve and a conductive regulating blade disposed opposite said conductive sleeve was set at 1.0 mm, the conductive sleeve was rotated at a speed of 50 rpm, a direct current bias voltage of 500 V was applied via a bias current, and the value of the current flowing to the regulating blade was measured. The temperature was 25±1° C. and relative humidity was 55±5%. Measurements were repeated five times and the average value calculated.

EXAMPLE 3

Carrier was produced in the same manner as in example 1 with the exception that 100 parts binder resin and 300 parts magnetic powder were used, and the cylinder temperature of the kneading device was set at 144° C.

EXAMPLE 4

Carrier was produced in the same manner as in example 1 with the exception that 100 parts styrene-acrylic resin (SBM-73F, Sanyo Kasei; softening point: 120° C.) was used as the binder resin, and 600 parts magnetic powder were used, and the cylinder temperature of the kneading device was set at 248° C.

COMPARATIVE EXAMPLE 8

Carrier was produced in the same manner as in example 1 with the exception that the cylinder temperature of the kneader was set at 150° C.

COMPARATIVE EXAMPLE 9

Carrier was produced in the same manner as in example 1 with the exception that the cylinder temperature of the kneader was set at 270° C.

EXAMPLES 3 AND 4, COMPARATIVE EXAMPLES 8 AND 9

Table 4 shows the conditions under which carriers in examples 3 and 4 and comparative examples 8 and 9 were produced, and table 5 shows the physical properties of the obtained carriers.

The carrier produced in example 3 had a volume-average particle size of 30 μm, and less than 2% of particles were 16 μm or less.

TABLE 4

| | L/D | No. of kneadings | Ln/D | 1st knead position | Final knead position | Knead unit spacing | Cylinder temp. C (° C.) | Kneader |
|---|---|---|---|---|---|---|---|---|
| Ex. 3 | 32 | 2 | 1.85 | 0.2 | 0.65 | 0.41 | 144 | ACM |
| Ex. 4 | 32 | 2 | 1.85 | 0.2 | 0.65 | 0.41 | 220 | ACM |
| CE. 8 | 32 | 2 | 1.85 | 0.2 | 0.65 | 0.41 | 150 | ACM |
| CE. 9 | 32 | 2 | 1.85 | 0.2 | 0.65 | 0.41 | 270 | ACM |

TABLE 5

| | Magnetic powder content (wt %) ($a_1$) | Amount exposed on particle (wt %) (b) | Shape coefficient | Dv/Dp | CDC (nA) |
|---|---|---|---|---|---|
| Ex. 3 | 75 | 5.0 | 0.94 | 1.11 | 35 |
| Ex. 4 | 85.7 | 8.5 | 0.88 | 1.21 | 75 |
| CE. 8 | 85.7 | 21.8 | 0.83 | 1.28 | 431 |
| CE. 9 | 85.7 | 20.7 | 0.81 | 1.29 | 366 |

EXAMPLE 5

Carrier was produced in the same manner as in example 1 with the exception that 100 parts binder resin, and 500 parts magnetic powder were used, and the manufacturing conditions were varied as shown in Table 6. The physical properties of the obtained carrier are shown in Table 7.

EXAMPLES 6 AND 7

Carrier was produced in the same manner as in example 1 with the exception that 100 parts binder resin, and 350 parts magnetic powder were used, and the manufacturing conditions were varied as shown in Table 6. The physical properties of the obtained carrier are shown in Table 7.

COMPARATIVE EXAMPLES 10 AND 11

Carriers were produced in the same manner as in example 1 with the exception that 100 parts binder resin, and 350 parts magnetic powder were used, and the manufacturing conditions were varied as shown in Table 6. The physical properties of the obtained carriers are shown in Table 7.

TABLE 6

| | L/D | No. of kneadings | Ln/D | 1st knead position | Final knead position | Knead unit spacing | Cylinder temp. C (° C.) | Kneader |
|---|---|---|---|---|---|---|---|---|
| Ex. 5 | 32 | 2 | 1.85 | 0.2 | 0.65 | 0.41 | 220 | ACM |
| Ex. 6 | 32 | 2 | 1.85 | 0.2 | 0.65 | 0.41 | 175 | ACM |
| Ex. 7 | 32 | 2 | 1.85 | 0.2 | 0.65 | 0.41 | 150 | ACM |
| CE. 10 | 32 | 2 | 1.85 | 0.2 | 0.65 | 0.41 | 120 | ACM |
| CE. 11 | 32 | 2 | 1.85 | 0.2 | 0.65 | 0.41 | 200 | ACM |

TABLE 7

| | Magnetic powder content (wt %) ($a_1$) | Amount exposed on particle (wt %) (b) | Shape coefficient | Dv/Dp | CDC (nA) |
|---|---|---|---|---|---|
| Ex. 5 | 83.3 | 12.2 | 0.89 | 1.22 | 81 |
| Ex. 6 | 77.7 | 4.6 | 0.94 | 1.09 | 44 |
| Ex. 7 | 77.7 | 11.0 | 0.90 | 1.14 | 69 |
| CE. 10 | 77.7 | 17.5 | 0.85 | 1.22 | 158 |
| CE. 11 | 77.7 | 13.8 | 0.87 | 1.27 | 206 |

The carriers obtained in examples 1–7 and comparative examples 1–11 are plotted in the graphs of FIGS. 2 and 3. Each carrier of examples 1–7 and comparative examples 1, 4, and 6–11 were mixed with a negatively chargeable toner for use in digital-type copying machine (model Di30, Minolta Co., Ltd.) of the reverse developing-type using an organic photosensitive member so as to produce developers having total toner content of 5 wt %. These developers were used to make copies using the model Di30 digital copier under laboratory conditions (i.e., temp: 25° C., humidity: 50%). The copier settings were the standard settings for the model Di30.

Evaluations were ranked as follows.

(1) Fog: fog formed on an image on a white sheet was visually examined and evaluated.

(2) Void: voids formed on halftone dot images were visually examined and evaluated.

(3) Uneven density: a copy image of a solid image having an optical density (OD) of 0.4 was measured at 2.5 locations using a reflective densitometer (MacBeth) and the density difference was calculated. Uneven density was evaluated by making copies under high temperature high humidity conditions (temp: 30° C., humidity: 85%) (H/H).

Evaluations (1)–(3) are ranked by standards in Table 8.

TABLE 8

| | Evaluation Standard | | | |
|---|---|---|---|---|
| (1) Fog | A rank 5 | B rank 3 or higher | — | D lower |
| (2) Void | A rank 5 | B rank 3 or higher | C rank 2 | D rank 1 |
| (3) Uneven Density | A less than 0.03 | B less than 0.05 | C less than 0.15 | D 0.15 or higher |

TABLE 9

| | Fog | Void | Uneven density |
|---|---|---|---|
| Ex. 1 | A | A | A |
| Ex. 2 | A | A | A |
| Ex. 3 | A | A | A |
| Ex. 4 | A | A | A |
| Ex. 5 | A | B | A |
| Ex. 6 | A | A | A |
| Ex. 7 | A | A | A |
| CE. 1 | D | D | D |
| CE. 4 | D | C | D |
| CE. 6 | D | C | C |
| CE. 7 | A | A | D |
| CE. 8 | D | C | A |
| CE. 9 | D | D | A |
| CE. 10 | D | C | A |
| CE. 11 | D | C | A |

In comparative example 2, transportability of the kneaded material was poor and the material blocked the transport unit due to the length of the total kneading length Ln.

In comparative example 3, the transportability of the kneaded material was poor and caused bridging because the first kneading unit was near the material supply aperture.

In comparative example 5, kneaded material blocked the transport unit and generated excessive load which stopped the kneading device because the final kneading unit was near the discharge aperture.

The present invention provides a binder-type carrier and a method of manufacturing same which is capable of producing high quality images having excellent image density without fog, voids, black spots, or uneven density when used as a carrier in developing.

Figure 5:
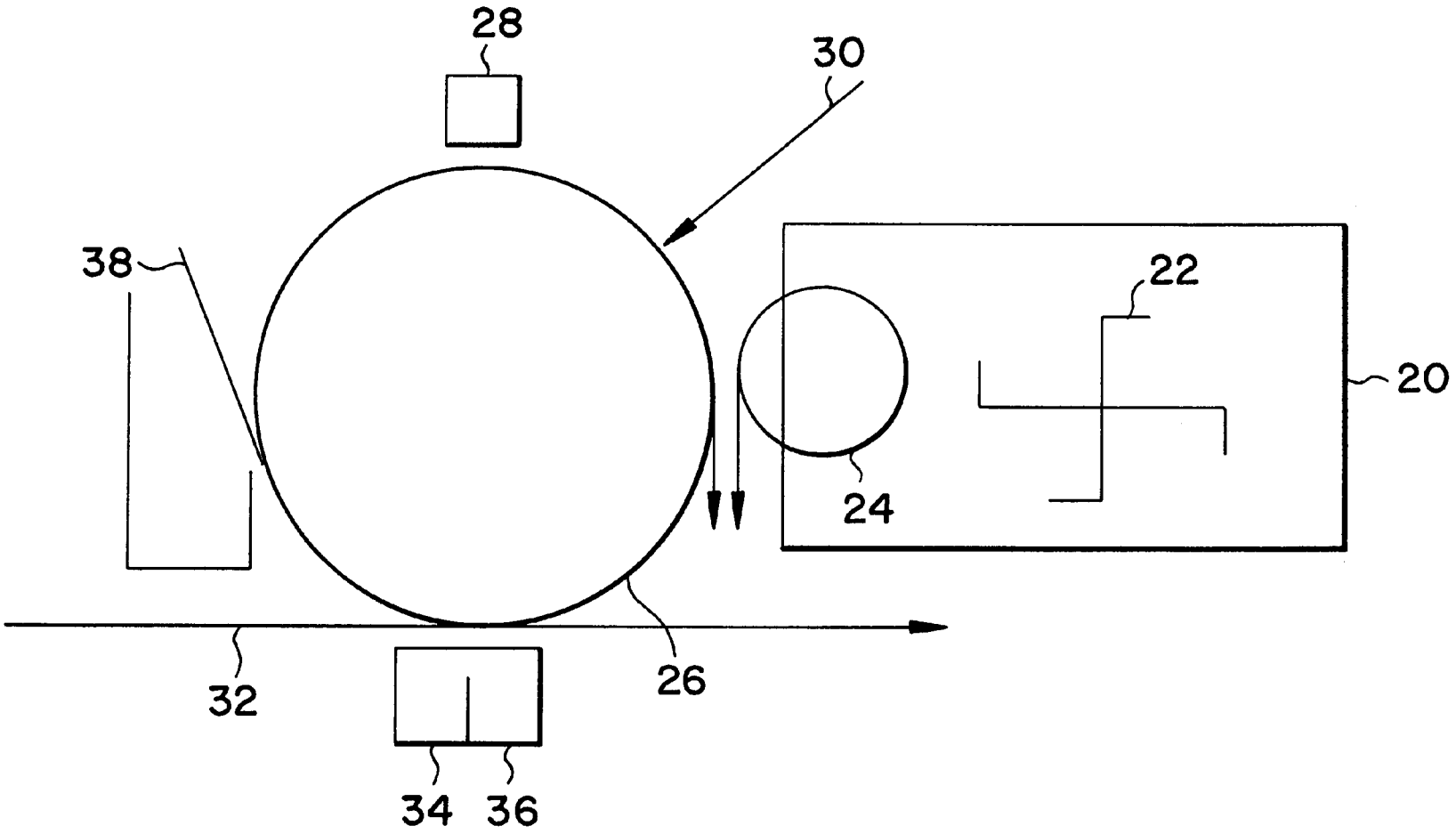
FIG. 5 illustrates a device that may employ the developers of the present invention.

FIG. 5 illustrates a device that may employ the developers of the present invention. The device includes a housing 20 for holding carrier and toner and within the housing is a mixing device 22 and a developing sleeve 24. Adjacent to and rotating in opposite direction of the developing sleeve 24 is an organic photosensitive member 26. The organic photosensitive member is uniformly charged with a corona charger or contact charger 28. A laser 30, is used to expose the organic photosensitive member 26 to provide exposed portions which respond to images. The developing sleeve 24 contacts the exposed portions allowing for image transfer onto the recording medium 32 with the aid of a transfer charger 34 and separating charger 36. Optionally, the device has a cleaner 38.

Figure 6:
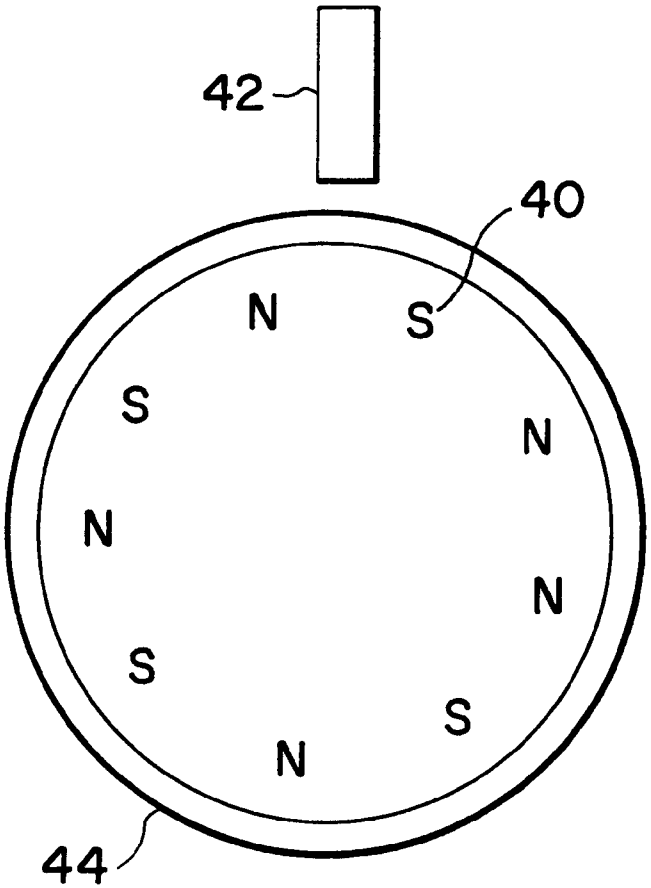
FIG. 6 illustrates a developing sleeve that may be used in the device illustrated in FIG. 5.

FIG. 6 is an enlarged view of the developing sleeve described in FIG. 5. The developing sleeve desirably includes magnetic material 40 fixed into the developing sleeve and a regulating member 42 which regulates the amount of developer adhered to the developing sleeve. Further, the developing sleeve desirably contains an outer shell 44 made of a non-magnetic material.

Although the present invention has been fully described by way of examples with reference to the accompanying drawings, it is to be noted that various changes and modification will be apparent to those skilled in the art. Therefore, unless such changes and modifications depart from the scope of the present invention, they should be construed as being included therein.

What is claimed is:

1. A carrier comprising:

a binder resin; and magnetic powder dispersed in said binder resin;

wherein the magnetic powder content a1 and the amount b of magnetic powder exposed on the carrier particle surface satisfies Equation (I)

$$b=0.4(a\mathbf{1}-80)+k\mathbf{1}$$

wherein a1 is about 75 to about 90 (wt %), and k1 is about 4 to about 13 (wt %), the carrier shape coefficient is about 0.8 to about 0.95, and the ratio Dv/Dp of the volume-average particle size Dv and the number-average particle size Dp is less than about 1.30.

2. The carrier according to claim 1, wherein the binder resin has a softening temperature in the range of about 110 to about 150° C.

3. The carrier according to claim 1, wherein the binder resin is a polyester resin, polystyrene resin, styrene-acrylic resin, phenolic resin, polyethylene resin, epoxy resin, urethane resin or mixtures thereof.

4. The carrier according to claim 1, wherein the ratio Dv/Dp is greater than 1.05.

5. The carrier according to claim 1, having an amount of exposed magnetic powder of about 2 to about 13 wt %.

6. The carrier according to claim 1, having a volume-average particle size of about 20 to about 80 $\mu$m.

7. The carrier according to claim 1, wherein the magnetic powder is ferrite.

8. A method for developing an electrostatic latent image comprising forming an electrostatic latent image on the surface of a negatively chargeable organic photosensitive member by reverse developing a two-component developer comprising the carrier defined in claim 1 and a negatively chargeable toner.

9. A method of manufacturing the carrier of claim 1 comprising: fusion kneading a mixture of at least a binder resin and a magnetic powder using an extrusion kneader having a cylinder, said fusion kneading be accomplished under conditions which satisfy the Equation (II)

$$c=7.2(a\mathbf{1}-75)+k\mathbf{2} \quad \text{(II)}$$

wherein C is the temperature of said cylinder; a1 is the magnetic powder content of the carrier which is about 75 to 90 wt % and k2 is a temperature with a range between the binder resin softening point and the softening point t 48° C.; and pulverizing said fusion kneaded material using a mechanical pulverizer.

10. The method of manufacturing according to claim 9, wherein said cylinder comprises a transport unit in an axial direction and two or more kneading units.

11. The method of manufacturing according to claim 10, wherein the total transport unit length is designated L, the total kneading unit length is designated Ln, the screw diameter is designated D, the transport unit length from a first kneading unit is designated L1, the transport unit length from a final kneading unit is designated Lx, and the spacing between kneading units is designated Ln', such that L/D is 23 or greater, Ln/D is less than 6, L1/L is 0.05 or greater, Lx/L is less than 0.87, and Ln'/L is less than 0.05.

12. The method according to claim 9, wherein the binder resin has a softening temperature in the range of about 110 to about 150° C.

13. The method according to claim 9, wherein the binder resin is a polyester resin, polystyrene resin, styrene-acrylic resin, phenolic resin, polyethylene resin, epoxy resin, urethane resin or mixtures thereof.

14. The method according to claim 9, wherein the ratio Dv/Dp is greater than 1.05.

15. The method according to claim 9, having an amount of exposed magnetic powder of about 2 to about 13 wt %.

16. The method according to claim 9, having a volume-average particle size of about 20 to about 80 $\mu$m.

17. The method according to claim 9, wherein the magnetic powder is ferrite.

18. A device for forming an electrophotographic image comprising a housing for holding carrier and toner, a developing sleeve interconnected to said housing, and an organic photosensitive member adjacent to said developing sleeve for transferring an image onto a recording medium, wherein said carrier is defined in claim 1.

19. The device according to claim 18, wherein said housing further comprises a mixer for mixing said toner and said carrier.

20. The device according to claim 18, wherein said developing sleeve comprises magnetic material fixed inside and an outer shell made of a non-magnetic material.

* * * * *